US012696949B2

(12) United States Patent
Gillon

(10) Patent No.: US 12,696,949 B2
(45) Date of Patent: Aug. 4, 2026

(54) NECK PROTECTION DEVICE

(71) Applicant: Lee Gillon, Montrose, CO (US)

(72) Inventor: Lee Gillon, Montrose, CO (US)

( * ) Notice: Subject to any disclaimer, the term of this patent is extended or adjusted under 35 U.S.C. 154(b) by 0 days.

(21) Appl. No.: 18/606,499

(22) Filed: Mar. 15, 2024

(65) Prior Publication Data

US 2024/0306756 A1 Sep. 19, 2024

Related U.S. Application Data

(60) Provisional application No. 63/490,340, filed on Mar. 15, 2023.

(51) Int. Cl.
*A42B 3/10* (2006.01)

(52) U.S. Cl.
CPC ..... *A42B 3/105* (2013.01)

(58) Field of Classification Search
CPC ..... A42B 3/105; A42B 3/085; A42B 3/142; A42B 1/24; A42B 1/0186; A42B 1/0187; F41H 1/04; F41H 1/08
See application file for complete search history.

(56) References Cited

U.S. PATENT DOCUMENTS 1,364,662 A * 1/1921 Wagner ..... A42B 1/0187 2/172
3,510,879 A * 5/1970 Webb ..... A42B 3/14 2/416
3,668,705 A 6/1972 Garbisch
5,329,641 A 7/1994 Kalhous
5,603,120 A * 2/1997 Gifford ..... A42B 3/105 2/172
5,701,609 A 12/1997 Bridges
6,260,204 B1 7/2001 Morrissey
8,468,613 B2 * 6/2013 Harty ..... A42B 3/0473 2/468
8,505,113 B2 * 8/2013 Crye ..... F41H 1/04 2/2.5
9,554,610 B2 * 1/2017 Sugerman ..... A42B 3/085
9,974,349 B2 * 5/2018 Gotti ..... A42B 3/085
11,206,879 B2 * 12/2021 Peterson ..... A42B 3/105
2006/0248623 A1 * 11/2006 Miller ..... F41H 1/04 89/914
2011/0094013 A1 4/2011 Zumwalt

* cited by examiner

*Primary Examiner* — Katherine M Moran
(74) *Attorney, Agent, or Firm* — Brennan, Manna & Diamond, LLC

(57) ABSTRACT

A neck protection device is disclosed that provides a hard hat neck and spine shield. The neck protection device comprises a body component that is configured as a flexible, multi-layer plate assembly that attaches to a hard hat via a hood that sits inside the suspension basket. During use, the device protects the rear neck area and the upper spine of a user. The body component can comprise additional plate components, which are connected to form a continuous chain of protection down the back of the user's neck. Thus, additional plate components can be added as needed.

5 Claims, 3 Drawing Sheets

NECK PROTECTION DEVICE

CROSS-REFERENCE TO RELATED APPLICATION

The present application claims priority to, and the benefit of, U.S. Provisional Application No. 63/490,340, which was filed on Mar. 15, 2023, and is incorporated herein by reference in its entirety.

FIELD OF THE INVENTION

The present invention relates generally to the field of neck protection devices. More specifically, the present invention relates to a hard hat neck and spine shield capable of covering the neck and protecting it against impact injuries. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in neck protection devices. Generally, people who use hard hats on construction sites may still lack protection for their neck and spine. Further, falling objects can significantly impact the neck on impact and cause serious injury. Additionally, if it begins raining or snowing, the back of the neck can get wet and uncomfortable if exposed to weather elements.

The neck is a vulnerable part of the body, containing many vital structures. Added to this, the head forms a heavyweight perched on the long, slender, mobile cervical spine, retained in position by the muscles supporting it. The impact of injury to the neck and/or cervical spine can be significant, if not catastrophic, and forces and impacts applied to the soft tissues (i.e., nerves, vasculature, the larynx, pharynx, or trachea) of the neck and/or the cervical spine can in turn cause related injuries such as concussion or unconsciousness, or even be fatal. Further, most hard hats used in construction are not suitable for protecting the cervical spine and soft tissues of the neck.

Accordingly, there is a demand for an improved neck protection device that is capable of covering the neck and protecting it against impact injuries. More particularly, there is a demand for a neck protection device that protects a user's neck and maintains optimal movement of the head and neck.

Therefore, there exists a long-felt need in the art for a neck protection device that provides users with a hard hat neck and spine shield capable of covering the neck and protecting it against impact injuries. There is also a long-felt need in the art for a neck protection device that utilizes a multi-layer plate assembly to offer ample protection when installed on the suspension basket of the hat. Further, there is a long-felt need in the art for a neck protection device that protects the neck area and upper spine. Moreover, there is a long-felt need in the art for a device that is especially useful for anyone wearing a hard hat on construction sites. Further, there is a long-felt need in the art for a neck protection device that maintains optimal movement of the head and neck. Finally, there is a long-felt need in the art for a neck protection device that offers protection without impeding hard hat function.

The subject matter disclosed and claimed herein, in one embodiment thereof, comprises a neck protection device.

The device is a multipurpose, hard hat neck and spine shield. The neck protection device comprises a body component that is configured as a flexible, multi-layer plate assembly that attaches to a hard hat via a hood that sits inside the suspension basket. During use, the device protects the rear neck area and the upper spine of a user. The body component can comprise additional plate components, which are connected to form a continuous chain of protection down the back of the user's neck. Additional plate components can be added as needed to create custom length protection of the neck.

In this manner, the neck protection device of the present invention accomplishes all of the foregoing objectives and provides users with a device that protects a user's neck and upper spine against impact injuries. The device is a multi-layer plate assembly that attaches to a hard hat. The device can be manufactured of a hard plastic or metal material.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a neck protection device. The device is a multipurpose, hard hat neck and spine shield. The neck protection device comprises a body component that is configured as a flexible, multi-layer plate assembly that attaches to a hard hat via a hood that sits inside the suspension basket. During use, the device protects the rear neck area and the upper spine of a user. The body component can comprise additional plate components, which are connected to form a continuous chain of protection down the back of the user's neck. Thus, additional plate components can be added as needed to create custom length protection of the neck.

In one embodiment, the neck protection device is secured to a hard hat or other similar helmet/hat. The neck protection device protects the rear neck area and upper spine by absorbing kinetic energy from an object (not shown), such as lumber, debris, bricks, rocks, baseballs, lacrosse balls, pucks, sticks, or another person's forearm, and/or deflecting the object away from the neck before the object strikes the neck's posterior region. Although the neck protection device is shown here coupled to a hard hat worn by a construction worker while working on a construction site, the neck protection device may be coupled to other types of gear that can position the body component over a person's neck, such as a hat or a visor that sits around a person's head, sports helmets, ski helmets, rock climbing helmets, etc. The neck protection device may also not be coupled to other types of gear, hats, helmets, etc., but rather directly to a person, such as the person's neck or head.

In one embodiment, the neck protection device offers protection without impeding hard hat function and while maintaining optimal movement of a user's head and neck. Accordingly, a user of the device has neck and spine protection, without impeding the range of motion of the user's cervical spine, such as lateral bending of the neck, rotation, flexion of the neck, and extension of the neck. In practice, this means a user of the device is able to move his or her head substantially in any direction. An advantage of the neck protection device is that it provides significant protection to the cervical spine and soft tissues of the user's neck while allowing a full range of functional movement, which is important on construction sites.

In one embodiment, the neck protection device includes a body component having a shape that is configured to cover the posterior region of each of the cervical vertebrae of a user's spine when the device is worn by the user to protect their rear neck area and upper spine. More specifically, the body component hangs down over the posterior region of a user's neck and forms a gap between the body component and the posterior region. The body component also has a material that, when a moving object strikes the material, absorbs kinetic energy from the moving object without breaking or deforming to the extent that the body component smashes against the posterior region of the user's neck. Further, the body component's material may deform elastically and/or plastically, but such deformation is not great enough to cause the body component to hit the posterior region of the user's neck. Instead, when a moving object strikes the body component, the bottom of the body component can contact the upper back of the user wearing the device, not the posterior region of the user's neck.

In one embodiment, the device also includes a securing means to position and hold the body component in place over the posterior region of each of the user's cervical vertebrae. By configuring the neck protection device in this manner, when a user wears the device to protect their neck, the securing means positions and holds the body component over the posterior region of each of the cervical vertebrae of the user's spine. Then, when an object like debris, wood, rocks, bricks, etc., moves or falls toward the user's neck, the object strikes the neck protection device, not the user's neck. The neck protection device then absorbs some of the kinetic energy from the object and deflects the object away from the user's neck. For example, a construction worker who walks under a portion of a construction site and debris falls on the back of his neck. Further, a batter who turns his back to a pitch that is high and inside might get hit by the ball in the posterior region of his neck or upper back. Similarly, a base runner in baseball who runs from first base to second base might get hit in the posterior region of his neck by a baseball thrown from the first baseman to the second baseman. If the construction worker, batter, and base runner are wearing the neck protection device, then the object would hit the device and get deflected away from the user's neck before seriously damaging his/her neck.

In one embodiment, the securing means may be any desired mechanism capable of positioning and holding the body component in place on the hard hat/helmet. For example, the securing means can include Velcro®, snaps and straps, adhesives, bolts, etc., to releasably position and hold the body component in place.

In one embodiment, the body component comprises a set of straps that are fastened to themselves via a snap fastener. The straps can be wrapped around the suspension basket of the hard hat/helmet and secured with the snap fasteners, such that the body component hangs down from the back end of the hard hat/helmet. Specifically, the body component is fastened to the interior of the hard hat/helmet via being secured to the hood part of the suspension basket. The hood part is the part that hangs down toward the back of a user's head when wearing the hard hat. The straps are wrapped around this or any other suitable back part of the suspension basket and secured via snap fasteners. Accordingly, in this embodiment, the strap also has the anchor. Thus, the strap is inserted around the suspension basket and then fastened back onto itself. To release the body component from the hard hat/helmet, one pulls each of the straps away from its respective snap fastener so that the snap fasteners disengage and release the strap. Generally, the snap fasteners are a conventional snap mechanism, with the first end of the top surface of the strap having the female portion of the snap, and the male portion being fastened to the second end of the back surface of the strap.

In one embodiment, the securing means is adjustable and may include a strap whose length is adjustable to allow the device to be worn closer or further away from the bottom end of the hard hat/helmet.

In one embodiment, the securing means may permanently, not releasably, fix the body component to the hard hat/helmet.

In one embodiment, the securing means include a mechanism that fastens the body component directly to the lower neck and/or the upper back of the user to help position and hold the body component over the posterior region of each of the cervical vertebrae, instead of the hard hat/helmet.

In one embodiment, additions to the body component can be added for a continuous chain of protection down the back of the user's neck. The additions are plate components that are sized and shaped to resemble the body component but can also be smaller or larger in size to the body component, depending on the needs and/or wants of a user. The plate components can be secured via any suitable securing means as is known in the art, such as Velcro, snaps, bolts, adhesives, etc. In one embodiment, the plate components are secured via snap fasteners, as the body component is secured to the hard hat/helmet. Specifically, the straps on the plate components are inserted around the straps of the body component or additional plate components positioned above and then fastened back onto themselves. Generally, the snap fasteners are a conventional snap mechanism, with the first end of the top surface of the strap having the female portion of the snap, and the male portion being fastened to the second end of the back surface of the strap. To release the plate component from the body component or additional plate component, one pulls each of the straps away from its respective snap fastener so that the snap fasteners disengage and release the strap. Accordingly, a continuous chain of protection can be created down the back of a user's neck. Additional plate components can be added as needed to customize a length of the device and provide custom neck protection, depending on the needs and/or wants, as well as the shape and/or size of a user's neck.

In one embodiment, when a moving object hits the neck protection device, the device absorbs some or all of the object's kinetic energy, and/or deflects the object away from the neck before the object strikes the neck's posterior region.

In one embodiment, the body component may include any desired material capable of performing these functions. For example, in this and other embodiments, the body component is approximately 0.125 inches thick and includes a composite material having the thermoplastic polymer acrylonitrile-butadiene-styrene (ABS). With the ABS composite, the body component has significant impact resistance and toughness to resist breaking when an object having a significant amount of kinetic energy hits the body component. With the ABS composite material, the body component may elastically deform when hit by an object traveling at high speeds but should not break.

Other embodiments are possible. For example, the body component may include a material that plastically deforms when hit by a moving object but does not plastically deform to the extent that the body component hits the posterior region of a user's neck. In one embodiment, the neck protection device (and all components) are made of a material that is sufficiently rigid to allow force to transfer from one component to the next. The rigid material must also be suitable to resist forces from debris and other sharp-edged objects. Thus, in this embodiment, the neck protection device is manufactured of a substantially rigid and puncture-resistant or ballistic material, such as Kevlar, fiberglass, carbon fiber, carbon fiber plastics, thermoplastics, and thermos-resins, or ultra-high molecular weight polyethylene ballistic fabric or any other ballistic, bulletproof, blast-proof material capable of dispersing force from punctures caused by falling objects, sharp bricks, rocks, fragments, or particles, etc.

In one embodiment, the body component also includes a shape that may be configured as desired to cover the posterior region of a user's cervical vertebrae and help the body component's material absorb kinetic energy from a moving object and/or deflect the object away from the user's neck. For example, in this and other embodiments, the shape of the body component is rectangular, measuring approximately six inches by four inches and curved about a longitudinal axis. This body component curvature is convex from the perspective of an object moving toward a user's neck when a user wears the device. This convex curvature provides the body component strength and flexibility and also causes most moving objects that impact the body component to glance off the body component at an oblique angle less than 90 degrees relative to the impact surface. By directing most impacts to glance off the body component at an oblique angle, the amount of kinetic energy that the body component absorbs elastically and/or plastically from the impact may be reduced.

In one embodiment, the body component also includes a top surface and a bottom surface, with opposing right and left ends, and opposing top and bottom ends. The bottom surface lies over a user's first cervical vertebrae, the vertebrae closest to a user's head, and over a user's last cervical vertebrae, the vertebrae farthest from a user's head.

In one embodiment, the bottom surface can comprise a pad to help protect a user's upper spine area from impacts caused by a moving object hitting the body component. The pad may be configured as desired to accomplish this. For example, the pad can include a foam material that cushions impact between the bottom surface and the user's neck. The pad is about 0.5 inches thick and covers substantially all of the inside surface of the body component. The pad also includes a curve that mimics the curvature of the body component.

In one embodiment, the body component comprises a sleeve that includes neoprene material and is sized to receive and retain the body component or additional plate components. The sleeve can protect the body component and make it easy to clean. Further, the sleeve can be oversized and substantially larger than the body component, so that the additional portion of the sleeve may protect a user's neck and/or shoulders from weather, such as rain, snow, hail, or the sun's ultraviolet radiation, etc.

In one embodiment, the body component comprises a reinforcing bar or other structural component to add strength and rigidity to the device. The reinforcing bar can be positioned under the straps or other securing means and is positioned horizontally, in-line with the length of the body component.

In one embodiment, the body component includes enough additional plate components that the device reaches the top of a user's shoulders and can be tucked inside a collar or shoulder gear to help position and hold the device over the posterior region of a user's cervical vertebrae.

In one embodiment, the body component includes enough additional plate components that the device covers the posterior region of each of the cervical vertebrae and one or more thoracic vertebrae, the vertebrae that lie just below the cervical vertebrae. The size and shape of the device in this embodiment, allows the device to be positioned such that the device is configured to transmit to one's trapezius muscle some or all of the kinetic energy that the device absorbs from an object striking the device. Because the trapezius is a large muscle it is better able to absorb and safely dissipate kinetic energy without causing serious damage to a user's body. Thus, by transmitting kinetic energy to a user's trapezius muscle, a user is better able to withstand a substantial impact from an object hitting the device.

In yet another embodiment, the neck protection device comprises a plurality of indicia.

In yet another embodiment, a method of protecting a user's neck and upper spine against impact injuries is disclosed. The method includes the steps of providing a neck protection device comprising a body component with at least one additional plate component. The method also comprises securing a predetermined number of additional plate components together in a chain. Further, the method comprises securing the body component to the suspension basket of a hard hat via the hood. Finally, the method comprises wearing the hard hat as is conventionally done in a construction setting.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
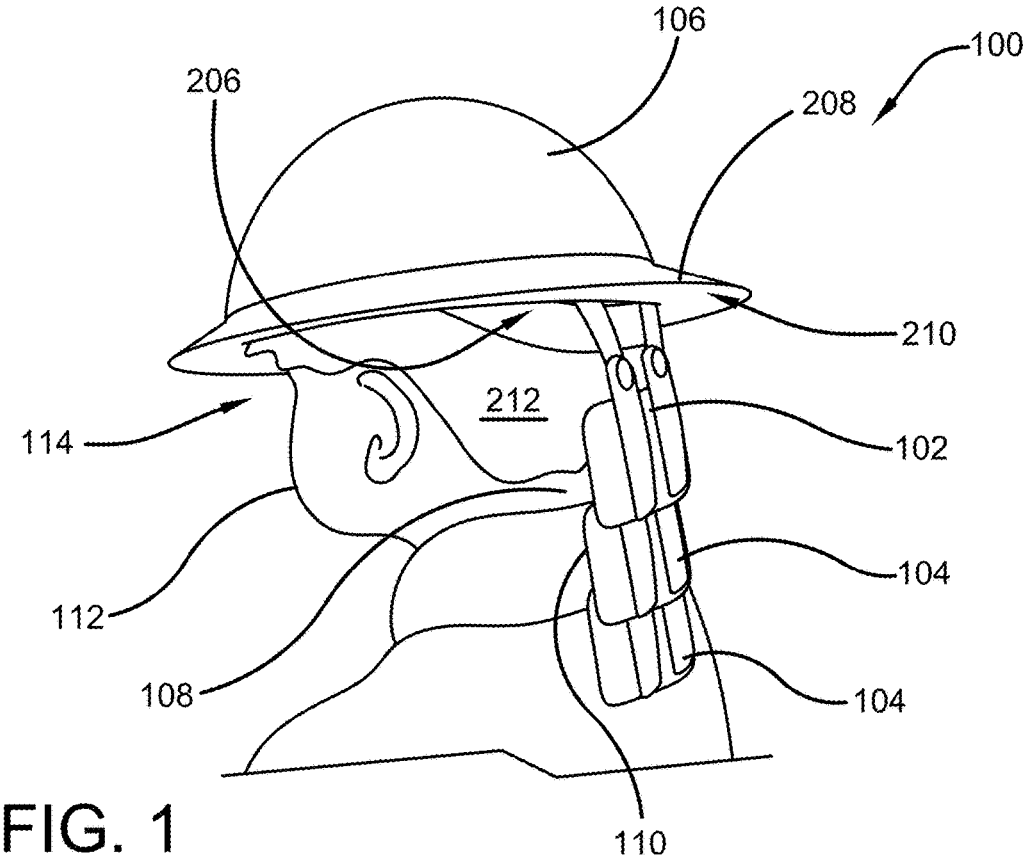
FIG. 1 illustrates a perspective view of one embodiment of the neck protection device of the present invention showing the device in use in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a neck protection device that provides users with a hard hat neck and spine shield capable of covering the neck and protecting it against impact injuries. There is also a long-felt need in the art for a neck protection device that utilizes a multi-layer plate assembly to offer ample protection when installed on the suspension basket of the hat. Further, there is a long-felt need in the art for a neck protection device that protects the neck area and upper spine. Moreover, there is a long-felt need in the art for a device that is especially useful for anyone wearing a hard hat on construction sites. Further, there is a long-felt need in the art for a neck protection device that maintains optimal movement of the head and neck. Finally, there is a long-felt need in the art for a neck protection device that offers protection without impeding hard hat function.

The present invention, in one exemplary embodiment, is a novel neck protection device. The neck protection device comprises a body component that is configured as a flexible, multi-layer plate assembly that attaches to a hard hat via a hood that sits inside the suspension basket. During use, the device protects the rear neck area and the upper spine of a user. The body component can also comprise additional plate components, which are connected to form a continuous chain of protection down the back of the user's neck. The present invention also includes a novel method of protecting a user's neck and upper spine against impact injuries. The method includes the steps of providing a neck protection device comprising a body component with at least one additional plate component. The method also comprises securing a predetermined number of additional plate components together in a chain. Further, the method comprises securing the body component to the suspension basket of a hard hat via the hood. Finally, the method comprises wearing the hard hat as is conventionally done in a construction setting.

Referring initially to the drawings, FIG. 1 illustrates a perspective view of one embodiment of the neck protection device 100 of the present invention. In the present embodiment, the neck protection device 100 is an improved neck protection device 100 that provides a user 112 with a multipurpose, hard hat neck and spine shield. Specifically, the neck protection device 100 comprises a body component 102 with at least one additional plate component 104, which is secured within a hard hat 106. During use, the device 100 protects the rear neck area 108 and the upper spine 110 of a user 112. The body component 102 and the additional plate components 104 are connected to form a continuous chain of protection down the back of the user's neck 108. Thus, additional plate components 104 can be added as needed to create custom length protection of the neck 108.

Generally, the neck protection device 100 is secured to a hard hat 106 or other similar helmet/hat. The neck protection device 100 protects the rear neck area 108 and upper spine 110 by absorbing kinetic energy from an object (not shown), such as lumber, debris, bricks, rocks, baseballs, lacrosse balls, pucks, sticks, or another person's forearm, and/or deflecting the object away from the neck 108 before the object strikes the neck's posterior region 108. Although the neck protection device 100 is shown here coupled to a hard hat 106 worn by a construction worker while working on a construction site, the neck protection device 100 may be coupled to other types of gear that can position the body component 102 over a person's neck 108, such as a hat or a visor that sits around a person's head, sports helmets, ski helmets, rock climbing helmets, etc. The neck protection device 100 may also not be coupled to other types of gear, hats, helmets, etc., but rather directly to a person, such as the person's neck 108 or head 114.

Furthermore, the neck protection device 100 offers protection without impeding hard hat function and while maintaining optimal movement of a user's head 114 and neck 108. Accordingly, a user 112 of the device 100 has neck and spine protection, without impeding the range of motion of the user's cervical spine 110, such as lateral bending of the neck 108, rotation, flexion of the neck 108, and extension of the neck 108. In practice, this means a user 112 of the device 100 is able to move his or her head 114 substantially in any direction. An advantage of the neck protection device 100 is that it provides significant protection to the cervical spine 110 and soft tissues of the user's neck 108 while allowing a full range of functional movement, which is important on construction sites.

Figure 2:
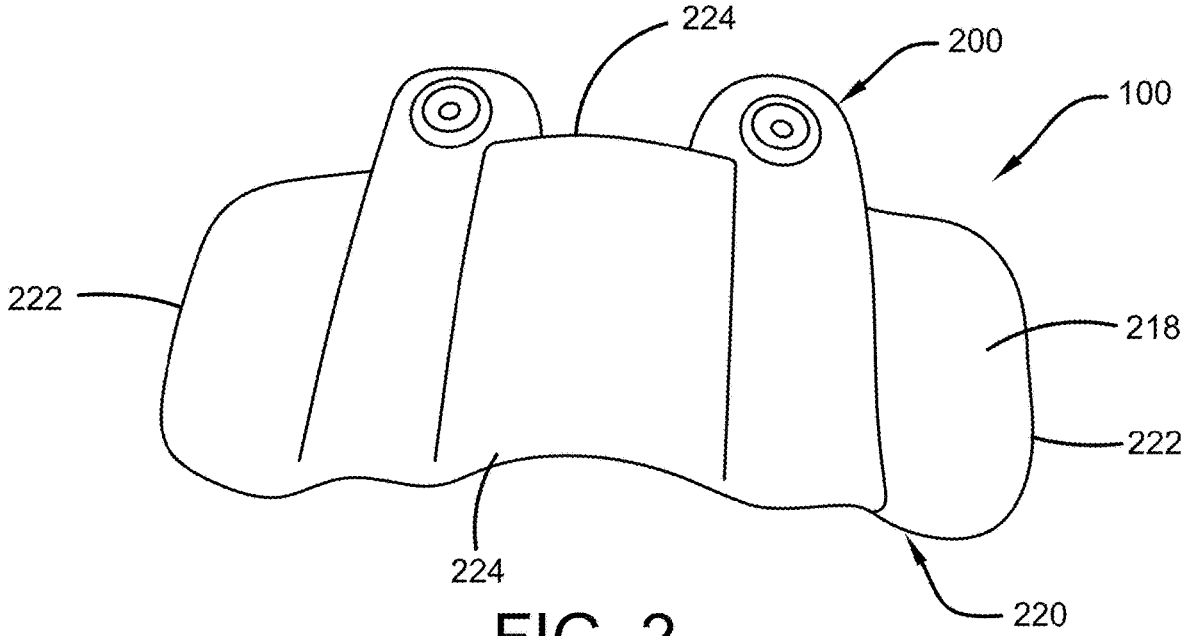
FIG. 2 illustrates a perspective view of one embodiment of the neck protection device of the present invention showing the body component of the device in accordance with the disclosed architecture.

As shown in FIG. 2, the neck protection device 100 includes a body component 102 having a shape that is configured to cover the posterior region of each of the cervical vertebrae of a user's spine 110 when the device 100 is worn by the user 112 to protect their rear neck area 108 and upper spine 110. More specifically, the body component 102 hangs down over the posterior region of a user's neck 108 and forms a gap between the body component 102 and the posterior region. The body component 102 also has a material that, when a moving object strikes the material, absorbs kinetic energy from the moving object without breaking or deforming to the extent that the body component 102 smashes against the posterior region of the user's neck 108. Further, the body component's material may deform elastically and/or plastically, but such deformation is not great enough to cause the body component 102 to hit the posterior region of the user's neck 108. Instead, when a moving object strikes the body component 102, the bottom of the body component 102 can contact the upper back of the user 112 wearing the device 100, not the posterior region of the user's neck 108.

Furthermore, the device 100 also includes a securing means 200 to position and hold the body component 102 in place over the posterior region of each of the user's cervical vertebrae. By configuring the neck protection device 100 in this manner, when a user 112 wears the device 100 to protect their neck 108, the securing means 200 positions and holds the body component 102 over the posterior region of each of the cervical vertebrae of the user's spine 110. Then, when an object like debris, wood, rocks, bricks, etc., moves or falls toward the user's neck 108, the object strikes the neck protection device 100, not the user's neck 108. The neck protection device 100 then absorbs some of the kinetic energy from the object and deflects the object away from the user's neck 108. For example, a construction worker who walks under a portion of a construction site and debris falls on the back of his neck 108. Further, a batter who turns his back to a pitch that is high and inside might get hit by the ball in the posterior region of his neck 108 or upper back. Similarly, a base runner in baseball who runs from first base to second base might get hit in the posterior region of his neck 108 by a baseball thrown from the first baseman to the second baseman. If the construction worker, batter, and base runner are wearing the neck protection device 100, then the object would hit the device 100 and get deflected away from the user's neck 108 before seriously damaging his/her neck 108.

Generally, the securing means 200 may be any desired mechanism capable of positioning and holding the body component 102 in place on the hard hat/helmet 106. For example, the securing means 200 can include Velcro®, snaps and straps, adhesives, bolts, etc., to releasably position and hold the body component 102 in place.

Typically, the body component 102 comprises a set of straps 202 that are fastened to themselves via a snap fastener 204. The straps 202 can be wrapped around the suspension basket 206 of the hard hat/helmet 106 and secured with the snap fasteners 204, such that the body component 102 hangs down from the back end 208 of the hard hat/helmet 106. Specifically, the body component 102 is fastened to the interior 210 of the hard hat/helmet 106 via being secured to the hood part 212 of the suspension basket 206. The hood part 212 is the part that hangs down toward the back of a user's head 114, when wearing the hard hat 106. The straps 202 are wrapped around this or any other suitable back part of the suspension basket 206 and secured via snap fasteners 204. Accordingly, in this embodiment, the strap 202 also has the anchor. Thus, the strap 202 is inserted around the suspension basket 206 and then fastened back onto itself. To release the body component 102 from the hard hat/helmet 106, one pulls each of the straps 202 away from its respective snap fastener 204, so that the snap fasteners 204 disengage and release the strap 202. Generally, the snap fasteners 204 are a conventional snap mechanism, with the first end of the top surface 214 of the strap 202 having the female portion of the snap 204, and the male portion being fastened to the second end of the back surface 216 of the strap 202.

Furthermore, the body component 102 also includes a shape that may be configured as desired to cover the posterior region of a user's cervical vertebrae and help the body component's material absorb kinetic energy from a moving object and/or deflect the object away from the user's neck 108. For example, in this and other embodiments, the shape of the body component 102 is rectangular, measuring approximately six inches by four inches and curved about a longitudinal axis. This body component 102 curvature is convex from the perspective of an object moving toward a user's neck 108 when a user 112 wears the device 100. This convex curvature provides the body component 102 strength and flexibility and also causes most moving objects that impact the body component 102 to glance off the body component 102 at an oblique angle less than 90 degrees relative to the impact surface. By directing most impacts to glance off the body component 102 at an oblique angle, the amount of kinetic energy that the body component 102 absorbs elastically and/or plastically from the impact may be reduced.

Additionally, the body component 102 also includes a top surface 218 and a bottom surface 220, with opposing right and left ends 222, and opposing top and bottom ends 224. The bottom surface 220 lies over a user's first cervical vertebrae, the vertebrae closest to a user's head 114, and over a user's last cervical vertebrae, the vertebrae farthest from a user's head 114.

Figure 3:
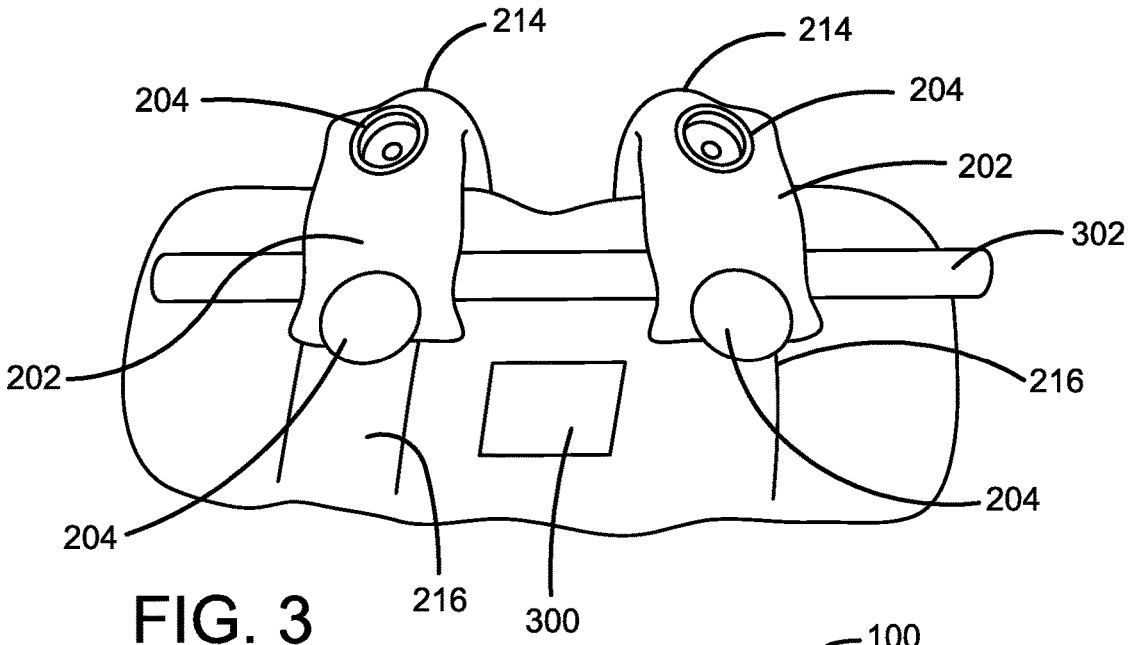
FIG. 3 illustrates a perspective view of one embodiment of the neck protection device of the present invention showing how the device is secured within a hard hat in accordance with the disclosed architecture.

As shown in FIG. 3, in one embodiment, the securing means 200 is adjustable and may include a strap 202 whose length is adjustable to allow the device 100 to be worn closer or further away from the bottom end 208 of the hard hat/helmet 106.

In another embodiment, the securing means 200 may permanently, not releasably, fix the body component 102 to the hard hat/helmet 106.

In yet another embodiment, the securing means 200 include a mechanism that fastens the body component 102 directly to the lower neck and/or the upper back of the user 112 to help position and hold the body component 102 over the posterior region of each of the cervical vertebrae, instead of the hard hat/helmet 106.

Further, the bottom surface 220 can comprise a pad 300 to help protect a user's upper spine area 110 from impacts caused by a moving object hitting the body component 102. The pad 300 may be configured as desired to accomplish this. For example, the pad 300 can include a foam material that cushions impact between the bottom surface 220 and the user's neck 108. The pad 300 is about 0.5 inches thick and covers substantially all of the inside surface (i.e., the bottom surface 220) of the body component 102. The pad 300 also includes a curve that mimics the curvature of the body component 102.

In one embodiment, the body component 102 comprises a reinforcing bar 302 or other structural component to add strength and rigidity to the device 100. The reinforcing bar 302 can be positioned under the straps 202 or other securing means 200 and is positioned horizontally, in-line with the length of the body component 102.

Figure 4:
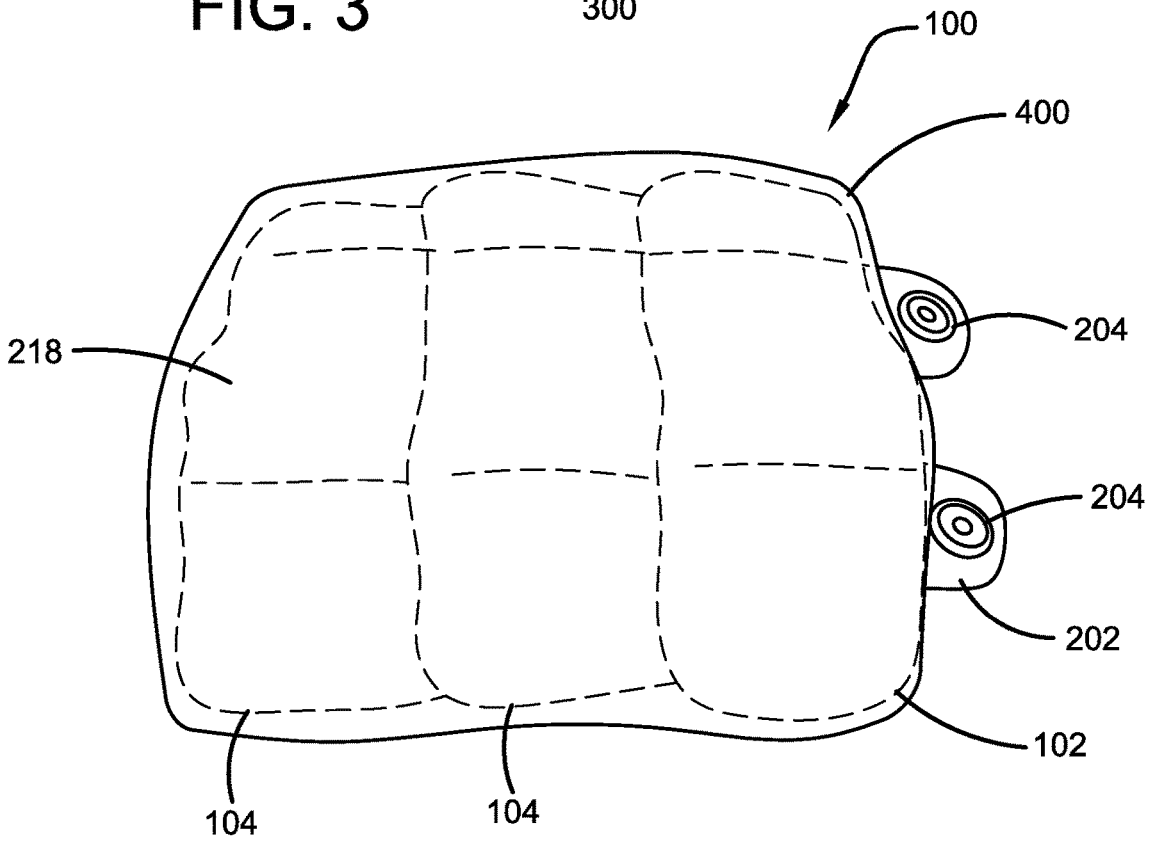
FIG. 4 illustrates a perspective view of one embodiment of the neck protection device of the present invention showing additional plate components being added together in accordance with the disclosed architecture.
Figure 5:
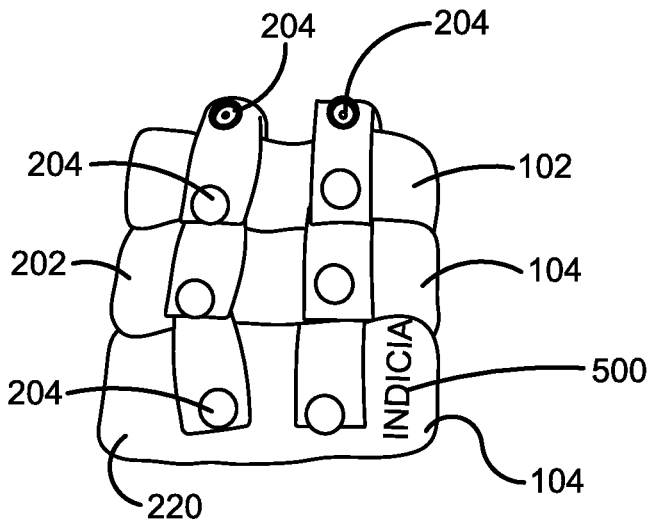
FIG. 5 illustrates a perspective view of one embodiment of the neck protection device of the present invention showing a continuous chain of additional plate components creating a custom length of neck protection in accordance with the disclosed architecture.

As shown in FIGS. 4-5, additions to the body component 102 can be added for a continuous chain of protection down the back of the user's neck 108. The additions are plate components 104 that are sized and shaped to resemble the body component 102 but can also be smaller or larger in size to the body component 102, depending on the needs and/or wants of a user 112. The plate components 104 can be secured via any suitable securing means as is known in the art, such as Velcro, snaps, bolts, adhesives, etc. In one embodiment, the plate components 104 are secured via snap fasteners 204, as the body component 102 is secured to the hard hat/helmet 106. Specifically, the straps 202 on the plate components 104 are inserted around the straps 202 of the body component 102 or additional plate components 104 positioned above and then fastened back onto themselves. Generally, the snap fasteners 204 are a conventional snap mechanism, with the first end of the top surface 214 of the strap 202 having the female portion of the snap 204, and the male portion being fastened to the second end of the back surface 216 of the strap 202. To release the plate component 104 from the body component 102 or additional plate component 104, one pulls each of the straps 202 away from its respective snap fastener 204, so that the snap fasteners 204 disengage and release the strap 202. Accordingly, a continuous chain of protection can be created down the back of a user's neck 108. Additional plate components 104 can be added as needed to customize a length of the device 100 and provide custom neck protection, depending on the needs and/or wants, as well as the shape and/or size of a user's neck 108.

Furthermore, when a moving object hits the neck protection device 100, the device 100 absorbs some or all of the object's kinetic energy, and/or deflects the object away from the neck 108 before the object strikes the neck's posterior region. Accordingly, the body component 102 may include any desired material capable of performing these functions. For example, in this and other embodiments, the body component 102 is approximately 0.125 inches thick and includes a composite material having the thermoplastic polymer acrylonitrile-butadiene-styrene (ABS). With the ABS composite, the body component 102 has significant impact resistance and toughness to resist breaking when an object having a significant amount of kinetic energy hits the body component 102. With the ABS composite material, the body component 102 may elastically deform when hit by an object traveling at high speeds but should not break.

Other embodiments are possible. For example, the body component 102 may include a material that plastically deforms when hit by a moving object but does not plastically deform to the extent that the body component 102 hits the posterior region of a user's neck 108. In one embodiment, the neck protection device 100 (and all components) are made of a material that is sufficiently rigid to allow force to transfer from one component to the next. The rigid material must also be suitable to resist forces from debris and other sharp-edged objects. Thus, in this embodiment, the neck protection device 100 is manufactured of a substantially rigid and puncture-resistant or ballistic material, such as Kevlar, fiberglass, carbon fiber, carbon fiber plastics, thermoplastics, and thermos-resins, or ultra-high molecular weight polyethylene ballistic fabric or any other ballistic, bulletproof, blast-proof material capable of dispersing force from punctures caused by falling objects, sharp bricks, rocks, fragments, or particles, etc.

In one embodiment, the body component 102 comprises a sleeve 400 that includes neoprene material and is sized to receive and retain the body component 102 or additional plate components 104. The sleeve 400 can protect the body component 102 and make it easy to clean. Further, the sleeve 400 can be oversized and substantially larger than the body component 102, so that the additional portion of the sleeve 400 may protect a user's neck 108 and/or shoulders from weather, such as rain, snow, hail, or the sun's ultra-violet radiation, etc.

In another embodiment, the body component 102 includes enough additional plate components 104 that the device 100 reaches the top of a user's shoulders and can be tucked inside a collar or shoulder gear to help position and hold the device 100 over the posterior region of a user's cervical vertebrae.

In one embodiment, the body component 102 includes enough additional plate components 104 that the device 100 covers the posterior region of each of the cervical vertebrae and one or more thoracic vertebrae, the vertebrae that lie just below the cervical vertebrae. The size and shape of the device 100 in this embodiment, allows the device 100 to be positioned such that the device 100 is configured to transmit to one's trapezius muscle some or all of the kinetic energy that the device 100 absorbs from an object striking the device 100. Because the trapezius is a large muscle it is better able to absorb and safely dissipate kinetic energy without causing serious damage to a user's body. Thus, by transmitting kinetic energy to a user's trapezius muscle, a user 112 is better able to withstand a substantial impact from an object hitting the device 100.

In yet another embodiment, the neck protection device 100 comprises a plurality of indicia 500. The body component 102 of the device 100 may include advertising, a trademark, or other letters, designs, or characters, printed, painted, stamped, or integrated into the body component 102, or any other indicia 500 as is known in the art. Specifically, any suitable indicia 500 as is known in the art can be included, such as, but not limited to, patterns, logos, emblems, images, symbols, designs, letters, words, characters, animals, advertisements, brands, etc., that may or may not be construction, neck protection, or brand related.

Figure 6:
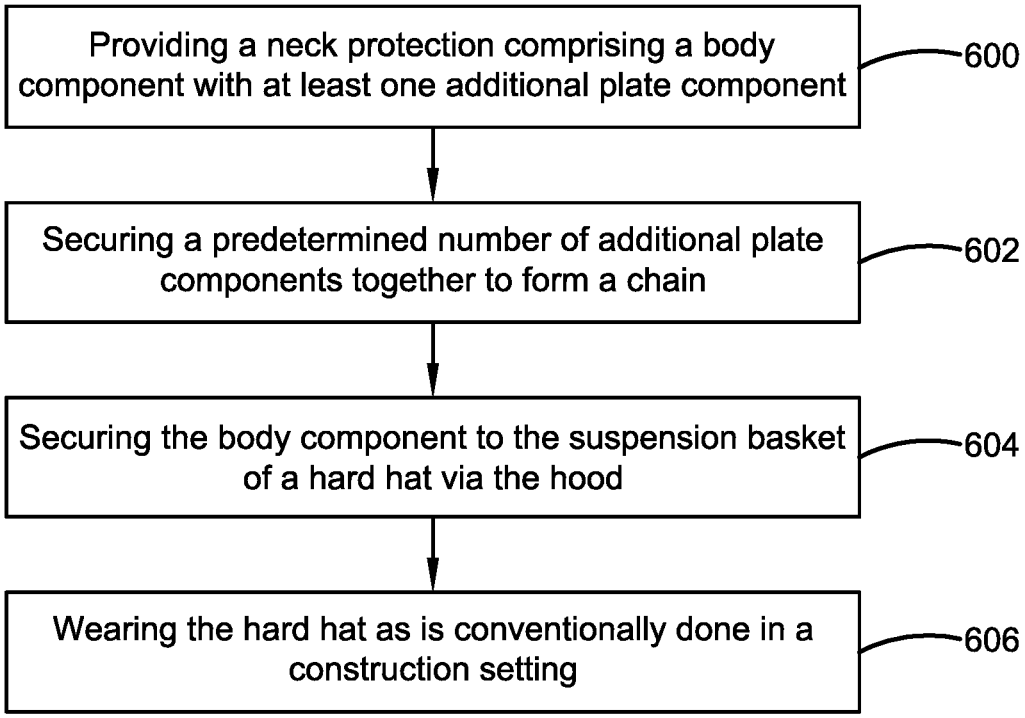
FIG. 6 illustrates a flowchart showing the method of protecting a user's neck and upper spine against impact injuries in accordance with the disclosed architecture.

FIG. 6 illustrates a flowchart of the method of protecting a user's neck and upper spine against impact injuries. The method includes the steps of at 600, providing a neck protection device comprising a body component with at least one additional plate component. The method also comprises at 602, securing a predetermined number of additional plate components together in a chain. Further, the method comprises at 604, securing the body component to the suspension basket of a hard hat via the hood. Finally, the method comprises at 606, wearing the hard hat as is conventionally done in a construction setting.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "neck protection device", "neck device", "protection device", and "device" are interchangeable and refer to the neck protection device 100 of the present invention.

Notwithstanding the foregoing, the neck protection device 100 of the present invention can be of any suitable size and configuration as is known in the art without affecting the overall concept of the invention, provided that it accomplishes the above-stated objectives. One of ordinary skill in the art will appreciate that the neck protection device 100 as shown in FIGS. 1-6 is for illustrative purposes only, and that many other sizes and shapes of the neck protection device 100 are well within the scope of the present disclosure. Although the dimensions of the neck protection device 100 are important design parameters for user convenience, the neck protection device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A neck protection device that provides a user with a multipurpose, hard hat neck and spine shield, the neck protection device comprising:

a body component having a shape that is configured to cover a posterior region of each of a cervical vertebrae of a user's spine when the neck protection device is worn by the user and is configured to form a gap between the body component and the posterior region;

a reinforcing bar; and a hard hat;

wherein the body component is rectangular, and curved about a longitudinal axis to provide strength and flexibility;

wherein once in place, the body component protects a rear neck area and upper spine of a user by absorbing kinetic energy from an object striking the body component without breaking or deforming;

wherein the neck protection device offers protection without impeding hard hat function and while maintaining optimal movement of a user's head and neck;

wherein the body component is secured to the hard hat via a set of straps that are fastened to themselves via a snap fastener, the set of straps are wrapped around a suspension basket of the hard hat and secured with the snap fasteners, such that the body component hangs down from a back end of the hard hat;

wherein at least one additional plate component is added to the body component to form a continuous chain of protection down a back of a user's neck; and wherein the at least one additional plate component is sized and shaped to resemble the body component and secured via snap fasteners, as the body component is secured to the hard hat;

wherein the reinforcing bar is positioned horizontally in-line with the body component under the set of straps and is configured to add rigidity to the neck protection device; and wherein the body component is an ultra-high molecular weight polyethylene ballistic fabric body.

2. The neck protection device of claim 1, wherein a bottom surface of the body component comprises a pad for extra cushioning.

3. The neck protection device of claim 1, wherein the body component comprises a sleeve for extra protection.

4. The neck protection device of claim 1 further comprising a plurality of indicia.

5. A method of protecting a user's neck and upper spine against impact injuries, the method comprising the following steps:

providing a neck protection device comprising a body component with at least one plate component and a reinforcing bar positioned horizontally in-line with the body component;

securing a predetermined number of additional plate components together in a chain;

securing the body component to a suspension basket of a hard hat via a hood; and wearing the hard hat in a construction setting; and wherein the body component is a fiberglass body component.

* * * * *